US006212815B1

(12) United States Patent
Fitzpatrick

(10) Patent No.: US 6,212,815 B1
(45) Date of Patent: Apr. 10, 2001

(54) MAGAZINE GRIP

(76) Inventor: Richard Mark Fitzpatrick, 1109 Par Rd., Broomfield, CO (US) 80020

( * ) Notice: Subject to any disclaimer, the term of this patent is extended or adjusted under 35 U.S.C. 154(b) by 0 days.

(21) Appl. No.: 09/293,403

(22) Filed: Apr. 16, 1999

(51) Int. Cl.[7] ..... F41A 15/00
(52) U.S. Cl. ..... 42/90; 42/106; 224/196
(58) Field of Search ..... 42/87, 88, 90, 42/106, 50, 18, 85; 224/196, 199, 223

(56) References Cited

U.S. PATENT DOCUMENTS

| | | | | |
|---|---|---|---|---|
| D. 33,384 | | 10/1900 | Thorn . | |
| 1,245,499 | | 11/1917 | Orme . | |
| 1,596,076 | | 8/1926 | Clancy . | |
| 1,797,951 | | 3/1931 | Gaidos . | |
| 2,205,967 | | 6/1940 | Wise . | |
| 2,825,991 | | 3/1958 | Stadelmann . | |
| 2,862,324 | * | 12/1958 | Ball | 42/50 |
| 3,000,527 | | 9/1961 | Jennings et al. . | |
| 3,623,256 | * | 11/1971 | Shiplee, III | 42/50 |
| 4,100,694 | * | 7/1978 | Musgrave | 42/90 |
| 4,442,962 | | 4/1984 | Musgrave . | |
| 4,484,404 | * | 11/1984 | Johnson | 42/90 |
| 4,528,765 | * | 7/1985 | Johnson | 42/70.11 |
| 4,628,627 | * | 12/1986 | Johnson | 42/90 |
| 4,720,931 | * | 1/1988 | Jensen | 42/87 |
| 4,796,937 | | 1/1989 | Andrea . | |
| 4,993,180 | * | 2/1991 | Upchurch | 42/87 |
| 5,279,059 | * | 1/1994 | Howard | 42/90 |
| 5,303,860 | * | 4/1994 | Serafini, Jr. | 224/238 |
| 5,319,872 | * | 6/1994 | Bammate | 42/88 |
| 5,402,594 | * | 4/1995 | Switzer | 42/90 |
| 5,452,534 | * | 9/1995 | Lambie | 42/18 |
| 5,664,355 | * | 9/1997 | Ronkainen | 42/18 |
| 5,806,224 | * | 9/1998 | Hager | 42/18 |

OTHER PUBLICATIONS

Sherwood's Clips, Magazines & Pouches. The Shotgun News. May 20, 1990. p. 132.*

* cited by examiner

*Primary Examiner*—Peter M. Poon
*Assistant Examiner*—Son T. Nguyen
(74) *Attorney, Agent, or Firm*—Geoffrey E. Dobbin

(57) ABSTRACT

A magazine grip attachment for ammunition magazines to aid in extraction of magazines from ammunition pouches comprising a sleeve of resilient material molded in the general shape of a magazine yet with a smaller inner circumference than the circumference of a magazine so as to require the band to stretch over the magazine. The top of the band has an even slightly smaller inner circumference than the lower part of the band. Extending from the top of the band is a handle designed to allow a finger to wrap around the handle and extract the magazine. Also provided are recessed areas and four diagonal force distribution beams to constrict the invention and allow it to grip a magazine more snugly when the handle is pulled. The invention is also used in combination with a magazine pouch to deaden noise by biasing the magazines against the pouch and each other.

56 Claims, 3 Drawing Sheets

MAGAZINE GRIP

FIELD OF INVENTION

The present invention relates to an attachment for ammunition magazines and more particularly to a magazine grip attachment with a finger pull-handle that may be positioned on the butt end of ammunition magazines in order to aid in both extraction from ammunition pouches and insertion into a weapon.

BACKGROUND OF THE INVENTION

The use of detachable loops to aid in the removal of ammunition magazines from a storage compartment is known in the prior art. Likewise, the use of handle attachments or extensions to carry ammunition magazines and other objects is also known. These attachments, while suitable for their individual purposes, are not as suitable for the purpose of this invention, namely extraction of ammunition magazines from ammunition pouches worn on the user. For example, U.S. Pat. No. 4,796,937 to Andrea; U.S. Pat. No. 4,442,962 to Musgrave; U.S. Pat. No. 3,000,527 to Jennings, et al.; U.S. Pat. No. 2,825,991 to Stadelmann; U.S. Pat. No. 2,205,967 to Wise; U.S. Pat. No. 1,797,951 to Gaidos; U.S. Pat. No. 1,596,076 to Clancy; U.S. Pat. No. 1,245,499 to Orme And U.S. Pat. No. D-33,384 to Thorn are all illustrative of the prior art.

Andrea, Douglas J.

Insulating Shell and Pouring Aid for Container and Method for Making the Same

U.S. Pat. No. 4,796,937

An insulating shell and carrier for a bottle in which the shell is formed of an insulating material. The shell has a main body section, with an opening into which the bottle fits, and an integral handle. The handle is a loop that the user may grasp to hold the bottle while pouring the liquid or may otherwise use to carry the bottle. The shell is preferably made out of a flat sheet of material, cut to the desired shape and size and joined at the edges to form a configuration matching the bottle.

Musgrave, Daniel D.

Magazine Hanger

U.S. Pat. No. 4,442,962

A cartridge magazine hanger adapted for quick removal of a magazine therefrom using only one hand. The magazine is supported by engagement of at least one of its feed lips with a support on the hanger. The hanger is equipped with loops that may be used to attach the hanger to any structure, vehicle, a person's clothing or even the weapon itself. The hanger also covers the feed mouth of the magazine to protect the ammunition from damage and prevent the entry of extraneous matter into the magazine.

Jennings, W. C, ET AL.

Handle for Containers

U.S. Pat. No. 3,000,527

This invention is a handle for containers, particularly glass milk containers. The handle is made of an elastomeric material comprising a band and finger grip potions. When warmed, the band portion slips over the rim of a glass milk container. When cooled, the band portion of the handle is not elastic enough to allow the container rim to slip out, thus allowing the user to carry the container using the finger grip portion of the handle.

Stadelmann, Rudolf

Magazine Arrangement for Medium Calibre Guns

U.S. Pat. No. 2,825,991

This arrangement is for medium caliber guns (20–40 mm caliber). The arrangement is essentially a box with one side open to allow for loading ammunition into the magazine. The top of this arrangement features a detachable metal loop to allow the user to extract the magazines from an ammunition chest.

Wise, Charles Rex

Rifle Magazine

U.S. Pat. No. 2,205,967

Magazine designed to increase capacity of a rifle and to relate the ammunition in a manner that automatically feeds ammunition through the rifle. A loop is provided on the butt and of the magazine so that it may be attached to the user's clothing or other device.

Gaidos, Alonzo F.

Firearms Magazine

U.S. Pat. No. 1,797,951

Magazine designed to expedite reloading when the magazine is empty. To this end, the magazine uses a retractable sliding plate to allow access to the interior of the magazine and to depress the follower plate, allowing ammunition to be loaded into the magazine. Attached to the sliding plate is a metal finger loop, allowing the user to pull the sliding and follower plates down.

Clancy, Kenneth A.

Bottle Carrier

U.S. Pat. No. 1,596,076

This bottle carrier is a single elongated strip of flexible material designed to accommodate assorted sizes of bottles. The strip accomplishes its purpose by means of two longitudinally extending slits cut in the strip. Using these slits, the strip may be looped around the neck of the bottle, under the rim. The free ends are then threaded through the slits and brought together to form a carrying loop.

Orme, Gardner P.

Firearm Magazine

U.S. Pat. No. 1,245,499

This magazine is designed to aid in the compression of the follower spring and thus aid in reloading the magazine. The invention is a magazine is designed to accommodate the insertion of a pin in its side, which may be used to compress the follower spring by simply squeezing the user's fingers, which are placed over the pin, towards the user's thumb, which is placed on the underside of the magazine. A loop, which is not essential to the invention, is nonetheless displayed in the drawings of this invention on the butt end of the magazine. Due to its size relative to the magazine, it can be presumed to be used for standard attachment purposes.

Thorn, Oliver

Gun-Carrying Attachment For Cycles

U.S. Pat. No. D-33,384

This simple design comprises of two bands of material. One forms an ellipse and the other forms a carrying loop with its ends attached to the elongated sides of the ellipse. The gun is presumably held in place by a small curved member placed on the ellipse.

While the aforementioned inventions accomplish their individual objectives, they do not describe an attachment that is used primarily for the extraction of ammunition magazines from ammunition pouches. Handle and loop attachments used in the prior art are mainly used for affixing an ammunition magazine to other objects, such as clothing or vehicles or to carry bottles. In the case where handle attachments are used for extraction, the handle is a simple metal wire forming a loop and is not adapted for use in the various positions a user may wear an ammunition pouch. In this respect, the magazine grip according to the present invention departs substantially from the usual designs in the prior art. In doing so, this invention provides an attachment that is primarily designed for the purpose of aiding the extraction of ammunition magazines from pouches worn on the user.

SUMMARY OF THE INVENTION

In view of the foregoing disadvantages inherent in the known types of handle attachments, this invention provides an improved attachment, a magazine grip. As such, the present invention's general purpose is to provide a new and improved attachment that will aid in the extraction of ammunition magazines from pouches worn on the user.

To attain this, the attachment essentially comprises a sleeve of resilient material, typically molded to fit over the butt end of an ammunition magazine, but alternatives, such as an elastic, knitted fabric, would also work. Extending from the center of the elongated sides of the sleeve is a handle, extending a length sufficient to allow a finger to be inserted into it. Ideally, this handle portion is molded of the same material as the sleeve and of one piece with the sleeve. The top area of the handle is also, typically, thickened to better withstand the stress of repeated use. Two triangular sections on each of the elongated sides of the sleeve and two trapezoidal sections extending around the shorter sides are recessed with respect to the rest of the sleeve. These recessed areas, being thinner than the rest of the sleeve, provide the elasticity needed to stretch the sleeve over an ammunition magazine. These sections and the thickened part of the handle are roughened so as to provide more friction for gripping the attachment When the handle is pulled, the attachment's design causes the sleeve to constrict around the magazine at the thicker areas of the sleeve, thus enabling the user to pull the magazine out of an ammunition pouch without the sleeve slipping off the magazine.

This design has numerous advantages over the prior art. First, the attachment is cleaner and easier to remove than the methods currently used in the field, namely looping some parachute cord and affixing it to the magazine via duct tape or simply creating a duct tape tab on the butt end of the magazine. Second, the sleeve increases friction between the fingers and the ammunition magazine, which allows for the easier conventional extraction of the magazine rather than prohibiting this means of extraction. Third, the standard means of ejection causes the butt end of the magazine to impact the ground. The molded handle acts as a shock absorber for the magazine when it is ejected from the rifle and subsequently reduces impact damage to the magazine. Fourth, the attachment is slightly wider than the compartments in an ammunition pouch. As such, the attachment raises the magazines off of the bottom of the pouch and lessens incidents of jamming of the first cartridge in the magazine. Raising the magazine also facilitates drying the ammunition in the event the pouch gets wet. Fifth, the attachment abuts against the attachments on other magazines in the pouch and against the lid of the pouch. This abutment effectively anchors one magazine against the magazines next to it and to the pouch and reduces noise caused both by the rattling of magazines against each other and up and down against the pouch when the user is moving.

The more important features of the invention have thus been outlined in order that the more detailed description that follows may be better understood and in order that the present contribution to the art may better be appreciated. Additional features of the invention will be described hereinafter and will form the subject matter of the claims that follow.

The primary aspect of the present invention is to provide a magazine grip attachment for use on ammunition magazines to aid in their extraction from ammunition pouches.

It is another aspect of the invention to provide an attachment that will accommodate users by being adaptable to individual styles of extraction, locations of the pouch on the user, and location of the rifle's magazine well.

It is an additional aspect of the invention to provide an attachment that increases friction on the butt end of the magazine to aid in the conventional extraction of the magazine from the ammunition pouch, instead of prohibiting this means of extraction.

It is yet another aspect of the invention to provide an attachment that is easily removed for replacement and cleaning and, when removed from the magazine, will not leave any residues that would increase cleaning time.

It is a further aspect of the invention to provide an attachment that will absorb some of the shock of impact when an ammunition magazine is ejected from a rifle.

It is a still further aspect of the invention to provide an attachment that will raise the magazines relative to the ammunition pouch, keeping ammunition from jamming and allowing water to drain from the magazine in the event to pouch gets wet.

It is an even further aspect of the invention to provide an attachment that will lessen noise caused by the rattling of ammunition magazines in the ammunition pouch.

It is yet another aspect of the invention to provide an attachment, the manufacture of which is readily adaptable to create such attachments for different sizes and calibers of hand held firearms.

Lastly, it is an aspect of the invention to provide a simple attachment that is easy and economical to manufacture so as to keep cost to the consuming public reasonable.

Other aspects of this invention will appear from the following description and appended claims, reference being made to the accompanying drawings forming a part of this specification wherein like reference characters designate corresponding parts in the several views.

Before explaining at least one embodiment of the invention in detail, it is to be understood that the invention is not limited in its application to the details of construction and the arrangements of the components set forth in the following description or illustrated in the drawings. The invention is capable of other embodiments and of being practiced and carried out in various ways. Also it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

DETAILED DESCRIPTION OF THE PREFERRED EMBODIMENT

Figure 1:
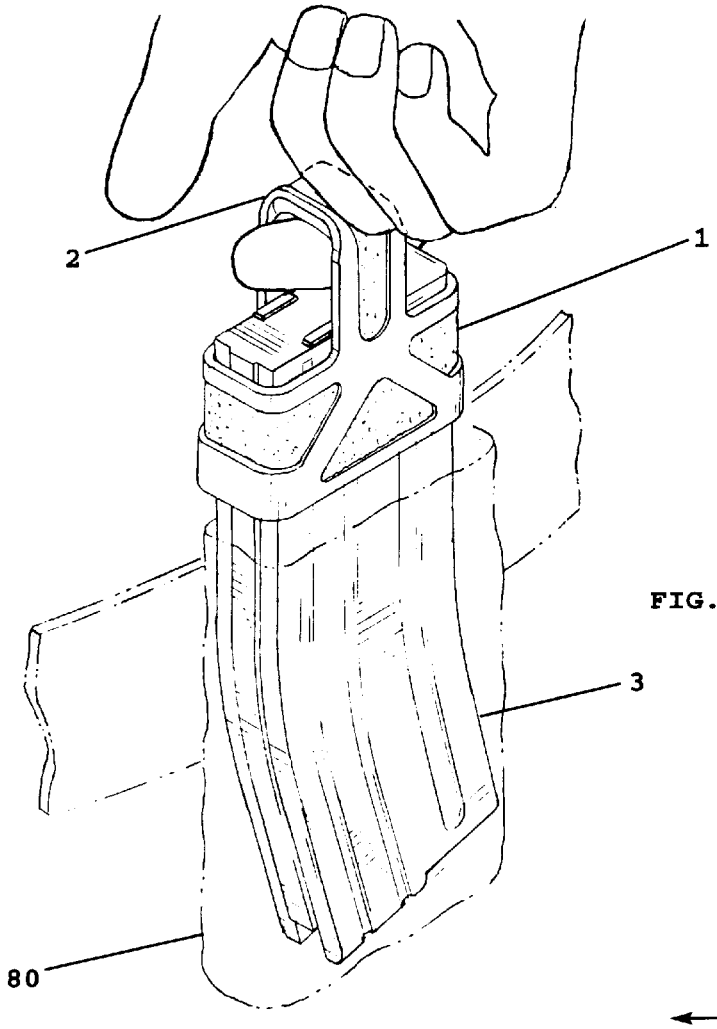
FIG. 1 is a perspective view of the invention secured on ammunition magazines in a one-magazine ammunition pouch.
Figure 2:
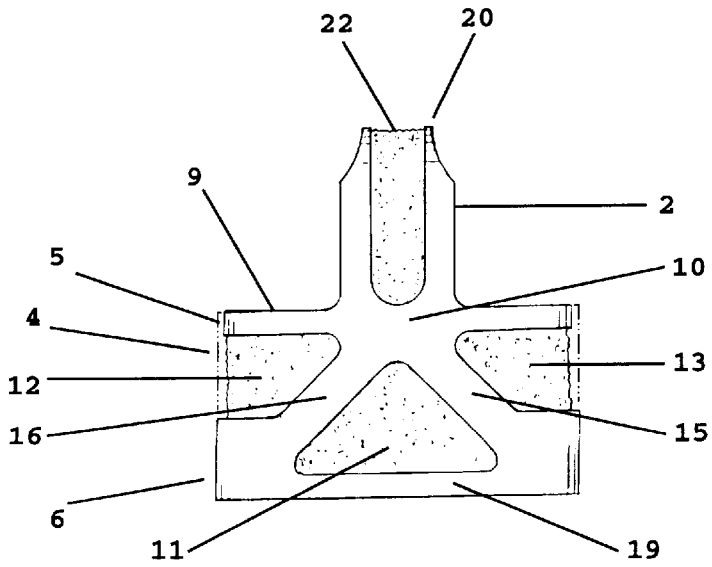
FIG. 2 is a side plan view of the invention.

With reference now to the drawings, the preferred embodiment of the new and improved magazine grip for ammunition magazines embodying the principles and concepts of the present invention will be described. Specifically, it will be noted in the figures, especially FIG. 1, that the invention relates to a sleeve of material snugly fitted over an ammunition magazine with a handle projecting from the top side of the sleeve. The invention is composed of a resilient material, such as silicone rubber or thermoplastic, and has two main features, a sleeve 1, with a width of approximately 1.5–1.75 inches though this may be varied depending on the type of magazine, designed to fit over the butt end of an ammunition magazine 3, which is stored in an ammunition pouch 80, and a handle 2, as shown in FIGS. 1 and 2. When composed of a moldable material, sleeve 1 is molded as a rectangular cylinder, corresponding to the dimensions of an ammunition magazine 3 and can also be said to have two parts, the upper 4 and lower 6 sections. Upper section 4 is molded with an interior circumference, $D_1$, slightly smaller than the circumference of an ammunition magazine, thus forcing it to stretch in order to fit over a magazine. Likewise, lower section 6 is also molded with an interior circumference, $D_2$, slightly smaller than that of an ammunition magazine, but also slightly larger than $D_1$. This can be easier seen in FIG. 4. A small breaking edge 8 is formed at the juncture of the two sections, shown in still greater detail in FIGS. 6*a* and 6*c*. When the magazine 3 is inserted in the invention, the upper section 4 is more taut than the lower section 6 and breaking edge 8 is stretched flush with the magazine's 3 wall, as shown in FIGS. 6*b* and 6*d*.

Referring again to FIG. 2, handle 2 extends from the top center of the sleeve 10, having both ends attached on the longitudinal sides of the sleeve 1. The handle 2 is approximately the same height as the width of the sleeve 1, though this may vary, and a width of 0.5 to 1.0 inch. The handle 2 is thicker at its apex 20 so as to better withstand the stress of pulling the invention and the magazine out of the pouch by the handle 2. The width of handle 2 at apex 20 is less than the rest of handle 2 so that a user's finger may curl around the loop. For ease of fabrication and to increase friction between a finger and the handle 2, the underside of the apex 20 is molded in a step-like pattern 21, as shown in FIG. 4.

Figure 4:
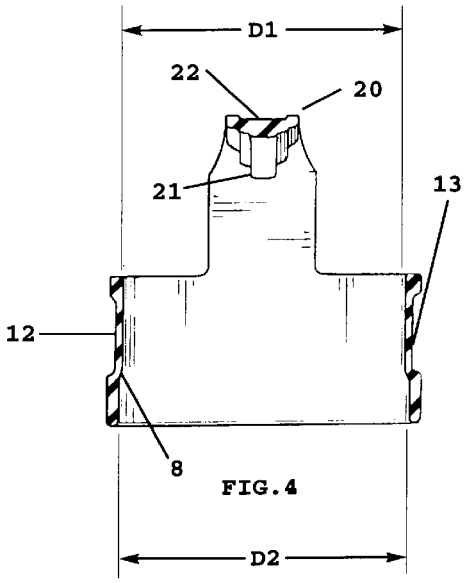
FIG. 4 is a longitudinal section of the invention taken along line 4 of FIG. 3.
Figure 5:
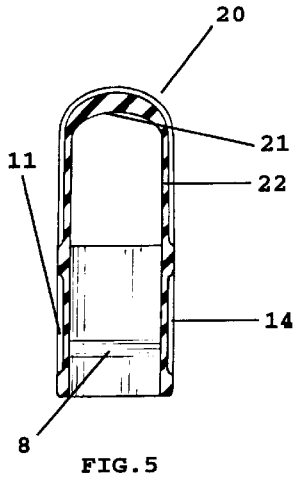
FIG. 5 is a cross section of the invention taken along line 5 of FIG. 3.

Referring to FIGS. 2, 4, 5, centrally located on and extending along the handle is one of five recessed areas 22. The remaining four recessed areas 11, 12, 13, 14, two of which, 12, 13, are in a triangular shape and two of which, 11, 14, are in a trapezoidal shape, define four diagonal force distribution beams (two shown in FIG. 2) 15, 16. The recessed areas 11, 12, 13, 14, 22 are all roughened to increase friction between the fingers and the invention. Since these areas are recessed, the friction between the magazine grip and the pouch or any other magazine grips is not increased by these areas' increased roughness. Instead, all areas of contact are smooth in order to facilitate extraction. The recessed areas 11, 12, 13, 14 also provide the elasticity necessary for the invention to be stretched over the butt of an ammunition magazine 3.

Figure 6A:
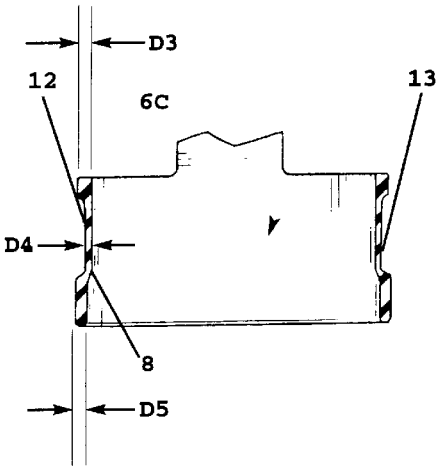
FIG. 6*a* is a sectional view of the invention, detailing the invention's braking structure.
Figure 6B:
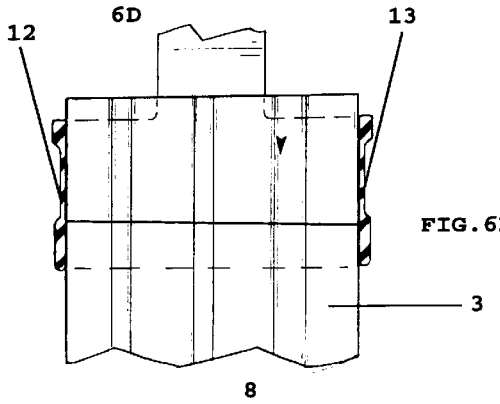
FIG. 6*b* is a sectional view of the invention showing the braking structure when the invention is placed on the butt end of an ammunition magazine.
Figure 6C:
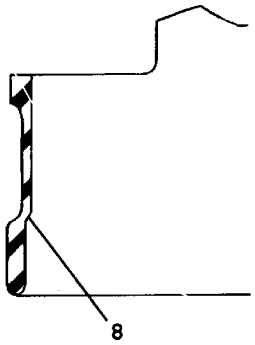
FIG. 6*c* is a close-up sectional view of the invention taken in circle 6*c* of FIG. 6*a*.
Figure 6D:
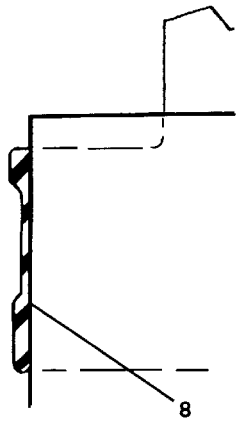
FIG. 6*d* is a close-up sectional view of the invention taken in circle 6*d* of FIG. 6*b*.

As shown in FIG. 6*a*, the thickness of the walls of the sleeve 1 vary, depending on the location of the recessed areas and whether the thickness is measured at the top or bottom of the sleeve. The walls at the top border 9 of the sleeve 1 have a thickness of $D_3$, at the recessed areas the thickness is $D_4$, and the thickness is $D_5$ at the bottom border 19 of the sleeve 1. The relationship between these three thickneses is as follows: $D_5>D_3>D_4$.

Figure 3:
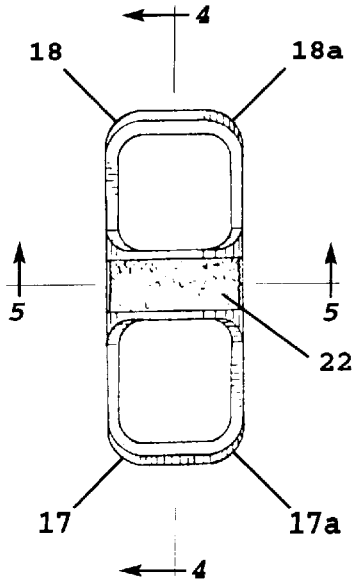
FIG. 3 is a top plan view of the invention.
Figure 7:
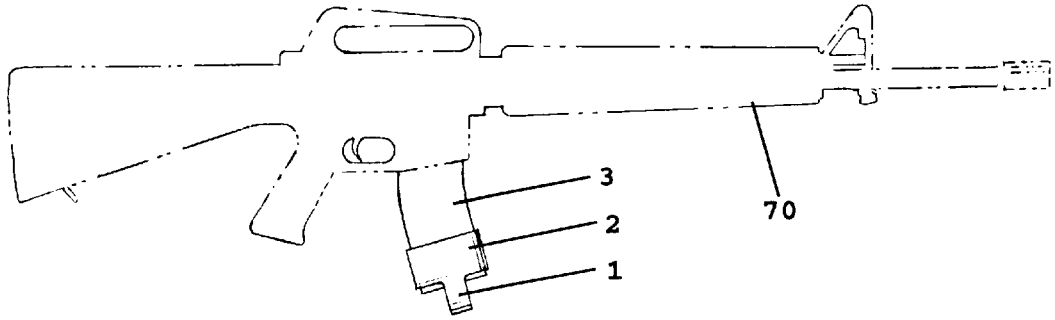
FIG. 7 is a side elevation of an M16 A-2 automatic rifle with the invention positioned on the rifle's ammunition magazine.

The beams 15, 15*a*, 16, 16*a* extend from the ends of the handle 2 at the top center of the sleeve 10 to the bottom corners of the sleeve 17, 17*a*, 18, 18*a*, which are shown in FIG. 3. When the handle 2 is pulled, the force of the pull is directed down the four distribution beams 15, 15*a*, 16, 16*a* towards the bottom corners of the sleeve 17, 17*a*, 18, 18*a*. This distribution causes the lower section 6 of the sleeve 1 to constrict along its lower border 19 and attempt to fold up over the upper section 4. However, the greater tension in the upper section 4 combined with the breaking edge 8 causes the upper section 4 to bow, which is shown in an exaggerated form 5 in FIG. 2, preventing the folding action and forcing the lower section 6 to grip the magazine as the user pulls the magazine 3 out of the ammunition pouch 80. The bottom corners 17, 17*a*, 18, 18*a* are molded with a greater thickness than the remaining areas of the sleeve 1 so as to better withstand the force placed on them during this operation. Once extracted from the pouch, the magazine 3 is then inverted and placed in the rifle 70, as seen in FIG. 7.

Figure 8:
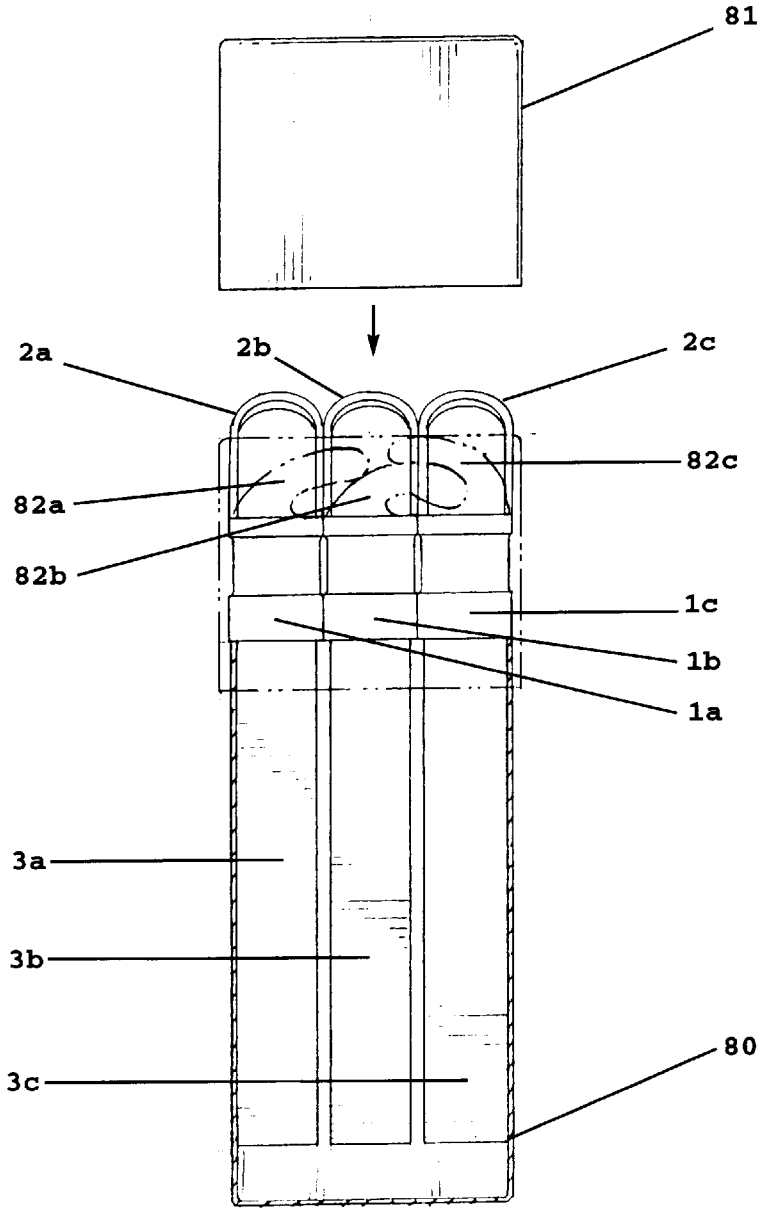
FIG. 8 is a cross section showing the combination of a three-magazine pouch with the invention and the folding of the invention's handles when the pouch is sealed.

Referring next to FIG. 8, three magazines 3*a,* 3*b,* 3*c* are inserted in a magazine pouch 80. The handles of three magazine grips 2*a,* 2*b,* 2*c* fold down into a stowed position, shown as 82*a,* 82*b,* 82*c,* over each other, when the pouch lid 81 is closed over the magazines. The sleeves 1*a,* 1*b,* 1*c* also abut each other and the sides of the pouch lid 81. As a result of the folding and the abutment, the magazines are effectively anchored against the pouch and each other, reducing both horizontal and vertical movements, and the noise, of the magazines while the user is in motion.

Although the present invention has been described with reference to preferred embodiments, numerous modifications and variations can be made and still the result will come within the scope of the invention. No limitation with respect to the specific embodiments disclosed herein is intended or should be inferred.

I claim:

1. A magazine grip comprising:

a cylindrical sleeve, not made of adhesive material, shaped and sized in conformity to receive an ammunition magazine; and a loop-shaped handle, having a both an upper and a bottom end, attached to the cylindrical sleeve by the handle's bottom end;

wherein the sleeve has both an interior and an exterior circumference and has both an upper and bottom end, said upper end being the end attached to the handle and each of said ends having a border and the upper end of the handle has an underside disposed towards the sleeve.

2. The magazine grip of claim 1, wherein the bottom end of the cylindrical sleeve has a larger interior circumference than the interior circumference of the upper end of the sleeve.

3. The magazine grip of claim 2, wherein the material from which the grip is manufactured is selected from the group consisting of silicone rubber, rubber, plastic, thermoplastic, and fabric.

4. The magazine grip of claim 3, wherein a plurality of hollows are fashioned in the sleeve and handle, each hollow defining an interior region.

5. The magazine grip of claim 4, wherein the interior regions of the hollows are roughened to increase friction for grasping said ammunition magazine.

6. The magazine grip of claim 5, wherein the sleeve height measures 1.5 to 1.75 inches and the handle measures 1.5 to 1.75 inches in height and 0.5 to 1 inch in width.

7. The magazine grip of claim 6, wherein the sleeve's bottom end's border and the underside of the handle's upper end are fashioned with greater thickness with respect to the rest of said magazine grip, thereby giving the sleeve's bottom end a greater exterior circumference than that of its upper end.

8. The magazine grip of claim 7, wherein the underside of the upper end of the handle is fashioned in a step-like pattern.

9. The magazine grip of claim 8, wherein the cylindrical sleeve is fashioned in a rectangular shape, having eight corners, in conformity with an ammunition magazine.

10. The magazine grip of claim 7, wherein the underside of the upper end of the handle is roughened to increase friction between the handle and a finger used to extract the magazine.

11. The magazine grip of claim 10, wherein the cylindrical sleeve is fashioned in a rectangular shape, having eight corners, in conformity with an ammunition magazine.

12. The magazine grip of claim 5, wherein the sleeve's bottom end's border and the underside of the handle's upper end are fashioned with greater thickness with respect to the rest of said magazine grip, thereby giving the sleeve's bottom end a greater exterior circumference than that of its upper end.

13. The magazine grip of claim 12, wherein the underside of the upper end of the handle is fashioned in a step-like pattern.

14. The magazine grip of claim 13, wherein the cylindrical sleeve is fashioned in a rectangular shape, having eight corners, in conformity with an ammunition magazine.

15. The magazine grip of claim 12, wherein the underside of the upper end of the handle is roughened to increase friction between the handle and a finger used to extract the magazine.

16. The magazine grip of claim 15, wherein the cylindrical sleeve is fashioned in a rectangular shape, having eight corners, in conformity with an ammunition magazine.

17. The magazine grip of claim 3, wherein the sleeve's bottom end's border and the underside of handle's upper end are fashioned with greater thickness with respect to the rest of said magazine grip, thereby giving the sleeve's bottom end a greater exterior circumference than that of its upper end.

18. The magazine grip of claim 17, wherein the underside of the upper end of the handle is fashioned in a step-like pattern.

19. The magazine grip of claim 18, wherein the cylindrical sleeve is fashioned in a rectangular shape, having eight corners, in conformity with an ammunition magazine.

20. The magazine grip of claim 17, wherein the underside of the upper end of the handle is roughened to increase friction between the handle and a finger used to extract the magazine.

21. The magazine grip of claim 20, wherein the cylindrical sleeve is fashioned in a rectangular shape, having eight corners, in conformity with an ammunition magazine.

22. The magazine grip of claim 2, wherein a plurality of hollows are fashioned in the sleeve and handle, each hollow defining an interior region.

23. The magazine grip of claim 22, wherein the interior regions of the hollows are roughened to increase friction for grasping said ammunition magazine.

24. The magazine grip of claim 23, wherein the sleeve's bottom end's border and the underside the handle's upper end are fashioned with greater thickness with respect to the rest of said magazine grip, thereby giving the sleeve's bottom end a greater exterior circumference than that of its upper end.

25. The magazine grip of claim 24, wherein the underside of the upper end of the handle is fashioned in a step-like pattern.

26. The magazine grip of claim 25, wherein the cylindrical sleeve is fashioned in a rectangular shape, having eight corners, in conformity with an ammunition magazine.

27. The magazine grip of claim 24, wherein the underside of the upper end of the handle is roughened to increase friction between the handle and a finger used to extract the magazine.

28. The magazine grip of claim 27, wherein the cylindrical sleeve is fashioned in a rectangular shape, having eight corners, in conformity with an ammunition magazine.

29. In combination with a magazine pouch suited to receive a plurality of magazines, the improvement comprising:

a. a magazine pouch having a top flap and walls;

b. a cylindrical sleeve, not made of adhesive material, shaped and sized in conformity to receive an ammunition magazine; and a loop-shaped finger handle, having an upper and bottom end, attached to the cylindrical sleeve by the handle's bottom end, mounted on the bottom end of ammunition magazines, wherein the sleeve has both an interior and an exterior circumference and has both an upper and bottom end, said upper end being the end attached to the handle and each of said ends having a border and the upper end of the handle has an underside disposed towards the sleeve and said magazines are inserted feed end down in said pouch; and the top flap of said pouch, wherein the handle act as a buffer and the sides of the sleeves abut each other and the walls of the flap, wherein motion of the magazines relative to the pouch and each other, and therefore noise, is reduced.

30. The improvement of claim 29, wherein the bottom end of the sleeve has a larger interior circumference than the interior circumference of the upper end of the sleeve.

31. The improvement of claim 30, wherein the material from which the grip is manufactured is selected from the group consisting of silicone rubber, rubber, plastic, thermoplastic, and fabric.

32. The improvement of claim 31, wherein a plurality of hollows are fashioned in the sleeve and handle, each hollow defining an interior region.

33. The improvement of claim 32, wherein the interior regions of the hollows are roughened to increase friction for grasping said ammunition magazine.

34. The improvement of claim 33, wherein the sleeve height measures 1.5 to 1.75 inches and the handle measures 1.5 to 1.75 inches in height and 0.5 to 1 inch in width.

35. The improvement of claim 34, wherein the sleeve's bottom end's border and the underside of the handle's upper end are fashioned with greater thickness with respect to the rest of said sleeve and handle, thereby giving the sleeve's bottom end a greater exterior circumference than that of it's upper end.

36. The improvement of claim 35, wherein the underside of the upper end of the handle is fashioned in a step-like pattern.

37. The improvement of claim 36, wherein the cylindrical sleeve is fashioned in a rectangular shape, having eight corners, in conformity with an ammunition magazine.

38. The improvement of claim 35, wherein the underside of the upper end of the handle is roughened to increase friction between the handle and a finger used to extract the magazine.

39. The improvement of claim 38, wherein the cylindrical sleeve is fashioned in a rectangular shape, having eight corners, in conformity with an ammunition magazine.

40. The improvement of claim 33, wherein the sleeve's bottom end's border and the underside of the handle's upper end are fashioned with greater thickness with respect to the rest of said sleeve and handle, thereby giving the bottom end a greater exterior circumference than that of the upper end.

41. The improvement of claim 40, wherein the underside of the upper end of the handle is fashioned in a step-like pattern.

42. The improvement of claim 41, wherein the cylindrical sleeve is fashioned in a rectangular shape, having eight corners, in conformity with an ammunition magazine.

43. The improvement of claim 40, wherein the underside of the upper end of the handle is roughened to increase friction between the handle and a finger used to extract the magazine.

44. The improvement of claim 43, wherein the cylindrical sleeve is fashioned in a rectangular shape, having eight corners, in conformity with an ammunition magazine.

45. The improvement of claim 31, wherein the sleeve's bottom end's border and the underside of the handle's upper end are fashioned with greater thickness with respect to the rest of said sleeve and handle, thereby giving the sleeve's bottom end a greater exterior circumference than that of its upper end.

46. The improvement of claim 45, wherein the underside of the upper end of the handle is fashioned in a step-like pattern.

47. The improvement of claim 46, wherein the cylindrical sleeve is fashioned in a rectangular shape, having eight corners, in conformity with an ammunition magazine.

48. The improvement of claim 45, wherein the underside of the upper end of the handle is roughened to increase friction between the handle and a finger used to extract the magazine.

49. The improvement of claim 48, wherein the cylindrical sleeve is fashioned in a rectangular shape, having eight corners, in conformity with an ammunition magazine.

50. The improvement of claim 30, wherein a plurality of hollows are fashioned in the sleeve and handle, each hollow defining an interior region.

51. The improvement of claim 50, wherein the interior regions of the hollows are roughened to increase friction for grasping said ammunition magazine.

52. The improvement of claim 51, wherein the sleeve's bottom end's border and the underside of the handle's upper end are fashioned with greater thickness with respect to the rest of said sleeve and handle, thereby giving the sleeve's bottom end a greater exterior circumference than that of its upper end.

53. The improvement of claim 52, wherein the underside of the upper end of the handle is fashioned in a step-like pattern.

54. The improvement of claim 53, wherein the cylindrical sleeve is fashioned in a rectangular shape, having eight corners, in conformity with an ammunition magazine.

55. The improvement of claim 52, where the underside of the upper end of the handle is roughened to increase friction between the handle and a finger used to extract the magazine.

56. The improvement of claim 55, wherein the cylindrical sleeve is fashioned in a rectangular shape, having eight corners, in conformity with an ammunition magazine.

* * * * *